US007020423B2

(12) United States Patent
Ono et al.

(10) Patent No.: US 7,020,423 B2
(45) Date of Patent: Mar. 28, 2006

(54) IMAGE HEATING APPARATUS AND IMAGE FORMING APPARATUS

(75) Inventors: Kazuaki Ono, Kashiwa (JP); Masayoshi Kachi, Abiko (JP); Daigo Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/763,166

(22) Filed: Jan. 26, 2004

(65) Prior Publication Data

US 2004/0223795 A1 Nov. 11, 2004

(30) Foreign Application Priority Data

Jan. 24, 2003 (JP) ..... 2003-016087

(51) Int. Cl.
*G03G 15/20* (2006.01)

(52) U.S. Cl. ..... 399/329

(58) Field of Classification Search ..... 399/329, 399/328; 219/216
See application file for complete search history.

(56) References Cited

U.S. PATENT DOCUMENTS 4,682,878 A * 7/1987 Takizawa et al. ..... 399/122
5,303,016 A * 4/1994 Oda et al. ..... 399/329
5,682,576 A 10/1997 Sakai et al. ..... 399/69
5,778,294 A * 7/1998 Hiraoka et al. ..... 399/329
6,243,559 B1 * 6/2001 Kurotaka et al. ..... 399/329
6,496,666 B1 * 12/2002 Hayashi et al. ..... 399/69
6,614,004 B1 9/2003 Moriya et al. ..... 219/216
2002/0131801 A1 * 9/2002 Tomatsu ..... 399/400
2002/0181979 A1 * 12/2002 Fukutome ..... 399/329

FOREIGN PATENT DOCUMENTS

JP 9-90787 4/1997
JP 2002-333789 11/2002

* cited by examiner

*Primary Examiner*—Robert Beatty
(74) *Attorney, Agent, or Firm*—Fitzpatrick, Cella, Harper & Scinto

(57) ABSTRACT

An image heating device includes a movable belt for heating an image on a recording material; a supporting member, having an elastic layer, for supporting the belt, the supporting member having an outer diameter which is larger in a central portion than at opposite end portions; a pressing rotatable member, pressed toward the supporting member with the belt interposed therebetween, for forming the nip for nipping and feeding the recording material; and pressing means for supporting opposite end portions of the supporting member and for pressing the supporting member and the pressing rotatable member toward each other; wherein a surface hardness of the supporting member through the belt is smaller than a surface hardness of the pressing rotatable member, and the pressing roller has a straight configuration in a longitudinal cross-section.

8 Claims, 10 Drawing Sheets

IMAGE HEATING APPARATUS AND IMAGE FORMING APPARATUS

FIELD OF THE INVENTION AND RELATED ART

The present invention relates to an image heating apparatus and an image forming apparatus.

An image forming apparatus of an electrophotographic type normally includes an image heating apparatus or fixing apparatus which receives a transfer material having toner electrostatically attracted thereon, the toner being made of resin material, magnetic material, coloring material or the like. In the fixing device, the transfer material is nipped and fed by a nip formed by heating means (roller, endless belt member or the like) and pressing means (roller, endless belt member or the like) which are press-contacted to each other, during which the toner is fused and fixed by heat and pressure. The present invention relates also to a heating apparatus of a heating belt type and an image forming apparatus provided with a heating apparatus comprising a flexible belt (film) which is movable and is heated by heating means, a back-up member supporting the belt, a pressing member for forming the nip in cooperation with the back-up member with the belt therebetween, wherein a material to be heated is introduced into between the belt and the pressing member at the nip so that material to be heated is heated by the heat of the belt while being fed. The heating apparatus of the heating belt type is used as an image heating device such as a fixing device for fixing an unfixed toner image formation on the recording material in an image forming apparatus (copying machine, facsimile machine, printer or the like) of an electrophotographic type or the like on a recording material by heat and pressure, a temporary fixing device for temporarily fixing the unfixed image on the recording material, or a surface property improving device for improving a surface property of the recording material carrying the fixed image. In addition to the image heating device, the present invention is applicable to heating means for heating a sheet-like member, for example, in a heat-drying device for evaporating water contained in paper.

The description will be made as to an exemplary image fixing device for an image forming apparatus such as a copying machine, printer or the like, wherein the fixing device fixes a toner image on a recording material by heating and pressing the recording material.

1) A Heating Roller Type Fixing Device:

In a widely used heating roller type fixing device for an image forming apparatus, an unfixed image (toner image) corresponding to image information formed on a recording material is fixed into a permanent fixed image by heat and/or pressure, wherein the toner image is formed directly on the recording material or through an image transfer process by image forming process station of an electrophotographic process, electrostatic recording process, magnetic recording process or another proper type on a recording material such as a transfer sheet, an electrofax sheet, an electrostatic recording sheet, an OHP sheet, a print sheet, a format paper, an envelope or the like.

The fixing device of a heating roller type comprising as basic elements a fixing roller (heating element) enclosing a halogen heater or the like (heating source), and a pressing roller (pressing member) press-contacted thereto. The rollers are rotated, and a recording material carrying an unfixed image is introduced into a press-contact nip (fixing nip) formed between the rollers. By the heat from the fixing roller and the pressure applied by the fixing nip, the unfixed image is fixed on the recording material into a permanent fixed image.

The heating roller type fixing device is used in a monochromatic image forming apparatus and a full-color image forming apparatus, as well. However, since a thickness of toner layer or layers on t recording material is larger in a full-color image than in a monochromatic image, and therefore, an amount of the deposited toner is large, it is desirable that length of the fixing nip measured in the feeding direction of the recording material (fixing nip width) is as large as possible, so that unfixed toner image an the recording material is heated at a temperature as low as possible for a long time in the printing step (fixing step).

In order to improve the glossiness of the recording material or the reproducibility of transparent color in an OHP recording material, a full-color fixing device of a heating roller type is widely used wherein the fixing roller and the pressing roller are provided with surface layers (heat resistive elastic layers) having highly smoothed or mirror surfaces.

However, in a full-color fixing device of the heating roller type, when the diameter of the roller is increased in an attempt to enlarge the nip width, the fixing device and therefore the entirety image forming apparatus are upsized. On the other hand, if the thickness of the surface layer of heat resistive elastic member is increased, the surface layer temperature of the fixing roller lowers due to the decrease of the heat supply speed attributable to the heat conduction from the heating source to the surface layer of the fixing roller, even to such an extent that unfixed toner cannot be fixed on the recording material (fixing defect). In order to avoid this, the printing speed is not enough to provide a required throughput (the number or prints per unit time), that is, not enough to follow the coming print data.

In order to downsize the fixing device while assuring the high throughput in the full-color fixing device, it is important to assure a large nip width while not decreasing the heat supply speed. However, as an enlarging method for the nip width, there are only the increase of the roller diameter and the increase of the thickness of the heat resistive elastic member. Therefore, there is a difficulty or limit in meeting the desire.

2) Fixing Device of Fixing Belt Type (Heating Belt Type):

In order to break the limit, a fixing device of a fixing belt type has been proposed in which the fixing belt is press-contacted to the pressing roller to form a nip.

The fixing device of the fixing belt type has a heating source disposed at a position away from the fixing roller so that warming-up time is reduced, and an endless type fixing belt is extended around the elastic roller and the heating roller, and the fixing roller and the pressing roller are pressed toward each other with the fixing belt therebetween. The recording material carrying the unfixed image is introduced into the nip formed therebetween (fixing nip), so that unfixed image is fixed into a permanent image on the recording material by the heat from the fixing belt and the fixing roller from the fixing nip.

In the fixing device of the fixing belt type, a large nip width can be easily assured as compared with the heating roller type by reducing the hardness of the elastic fixing roller. In addition, since the fixing belt having a small thermal capacity is heated by the heating roller, the fixing belt can be quickly heated, and the recording material can be heated without reduction of the heat supply speed. Thus, the warming-up time can be reduced, and a high speed printing is possible with a small size structure.

When the fixing belt type is used in the fixing device of the image forming apparatus, the conventional elastic fixing roller of the low hardness is such that outer diameter of the elastic fixing roller at the longitudinally central portion is larger than the outer diameter at the longitudinal end portions, as disclosed in Japanese Laid-open Patent Application Hei 09-090787 and Japanese Laid-open Patent Application2002-333789. With such a structure, when the belt is rotated, the belt is prevented to shifting toward the central portion, and by making the rotation distance at the central portion larger than the rotation distance at the end portions, the central portion of the belt is prevented from slacking.

However, in Japanese Laid-open Patent Application2002-333789, there is disclosed a structure in which the outer diameter of the fixing roller at the central portion is larger than at the opposite end portions, and outer diameter of the pressing roller at the central portion is smaller than at the opposite ends portions. When the fixing operation continues for a long time with such a structure, the pressing roller becomes warmer with the result that nip widths at the opposite end portions become larger than at the central portion due to the thermal expansion difference caused by the difference in the rubber layer thickness between the central portion and the opposite end portions. As a result, a distribution or the nip width with respect to the direction of the generating line of the roller changes from the initial stage of the fixing operation such that difference in the nip width between the central portion and the end portions becomes larger after a long time continuing fixing operation. In view of this, a straight configuration of the pressing roller is preferable to avoid glossiness non-uniformity with respect to the axial direction of the roller which may otherwise occur after a long time fixing operation. It is required to prevent paper crease which relatively easily occur with the straight configuration roller.

SUMMARY OF THE INVENTION

Accordingly, it is a principal object of the present invention to provide an image heating device and an image forming apparatus wherein a glossiness non-uniformity and paper crease production can be effectively prevented.

It is another object of the present invention to provide an image heating device and an image forming apparatus wherein a feeding performance of the belt is stabilized, and the image defect can be prevented.

According to an aspect of the present invention, there is provided an image heating device includes a movable belt for heating an image on a recording material; a supporting member, having an elastic layer, for supporting the belt, the supporting member having an outer diameter which is larger in a central portion than at opposite end portions; a pressing rotatable member, pressed toward the supporting member with the belt interposed therebetween, for forming the nip for nipping and feeding the recording material; and pressing means for supporting opposite end portions of the supporting member and for pressing the supporting member and the pressing rotatable member toward each other; wherein a surface hardness of the supporting member through the belt is smaller than a surface hardness of the pressing rotatable member, and the pressing roller has a straight configuration in a longitudinal cross-section.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Embodiment 1

(1) Example of Image Forming Apparatus

Figure 1:
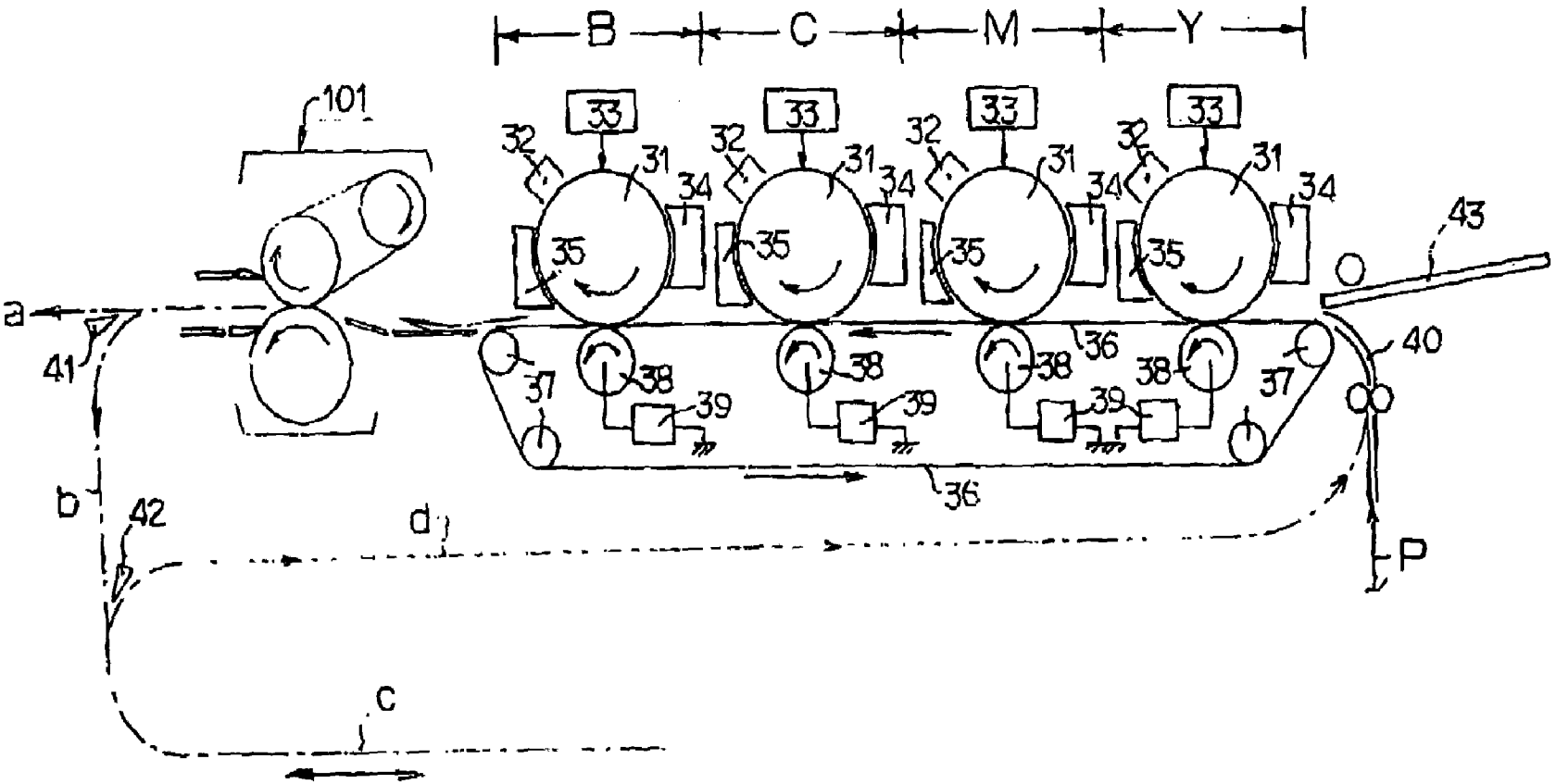
FIG. 1 illustrates a schematic general arrangement of an exemplary image forming apparatus.

FIG. 1 is a schematic view of an example of an image forming apparatus provided with a fixing device as an image heating device according to an embodiment of the present invention. The image forming apparatus of this embodiment is a full color printer of a tandem type having an automatic both-side-printing function, using an electrophotographic process.

Designated by Y, M, C and B are first—fourth image forming stations disposed in this order from the right side in the drawing.

Each of the image forming stations Y, M, C, and B is an electrophotographic processing mechanism comprising an image bearing member in the form of a rotatable drum type electrophotographic photosensitive member 31, an exposure device 33 such as a charging device 32, a laser scanner, LED array or the like, a developing device 34, a cleaning device 35 and so on. The photosensitive member 31 is rotational driven in the clockwise direction indicated by an arrow at a predetermined peripheral speed.

The first image forming station Y forms a yellow component toner image of the full-color image on the surface of the photosensitive member 31. The second image forming station M forms a magenta component toner image of the full-color image on the surface of the photosensitive member 31. The third image forming station C forms a cyan component toner image or the full-color image on the surface of the photosensitive member 31. The fourth image forming station B forms a black component toner image of the full-color image on the surface of the photosensitive member 31. The toner image forming process in each of the image forming station is the one which is well-known, and therefore, the description thereof is omitted for simplicity.

Designated by 36 is a transfer belt extended around a plurality of supporting rollers 37, and is disposed below the first-fourth image forming stations Y, M, C, B. The transfer belt 36 is rotated in the counterclockwise direction indicated by an arrow at a peripheral speed corresponding to the peripheral speed of the photosensitive member 31.

Designated by 38 is a transferring electrode roller is disposed below the photosensitive member 31 of each of the first-fourth image forming stations so as to be pressed toward the photosensitive member 31 with the transfer belt 36 therebetween to form a transfer nip. Designated by 39 is a transfer bias application voltage source for applying a transfer bias voltage to the transferring electrode rollers 38, and it applies the predetermined transfer bias voltage having a polarity opposite to the charge polarity of the toner at predetermined control timing.

Designated by 40 is a sheet feeding path, along which a recording material (transfer material) singled out of an unshown sheet feeding mechanism portion is fed to a first image forming station side end portion of the transfer belt 36. Designated by 43 is a manual feed tray from which a recording material P can be fed manually.

The transfer belt 36 electrostatically attracts t fed recording material P or grips it by a chuck, and carries the recording material through the transfer nips of the first, second, third and fourth image forming stations Y, M, C and B. By this, a yellow toner image, a magenta toner image, a cyan toner image and black toner image are sequentially transferred in a registered superposing relationship on the same surface of the recording material P, thus forming a full-color toner image.

The recording material P having passed through the transfer nip of the image forming station B is separated from the transfer belt 36, and is introduced into the fixing device 101 (heating apparatus) so that transferred (unfixed) toner image is fixed.

In the monochromatic printing mode, only the fourth image forming station B for forming the black toner image is operated.

In the case of a one side-printing mode, the recording material P discharged from the fixing device 101 is discharged to the outside through sheet path a.

In the case of automatic both-side-printing mode, the recording material P now having the printed image on the first surface and discharged from the fixing device 101 is introduced into a sheet path b by switching of a flapper 41 and is fed to recirculation/feeding mechanism and is introduced into the switch-back path c, and is then switched back and fed to the sheet path d by switching the flapper 42. Thus, the recording material is refed to the first image forming station Y side end of the transfer belt 36 with the face orientation reversed. Then, the toner image is transferred onto the second surface of the recording material P and is refed into the fixing device 101, so that toner image is fixed on the second surface side of the recording material. The recording material P discharged from the fixing device 101 discharged along the sheet path a to the outside.

(2) Fixing Device 101

Figure 2:
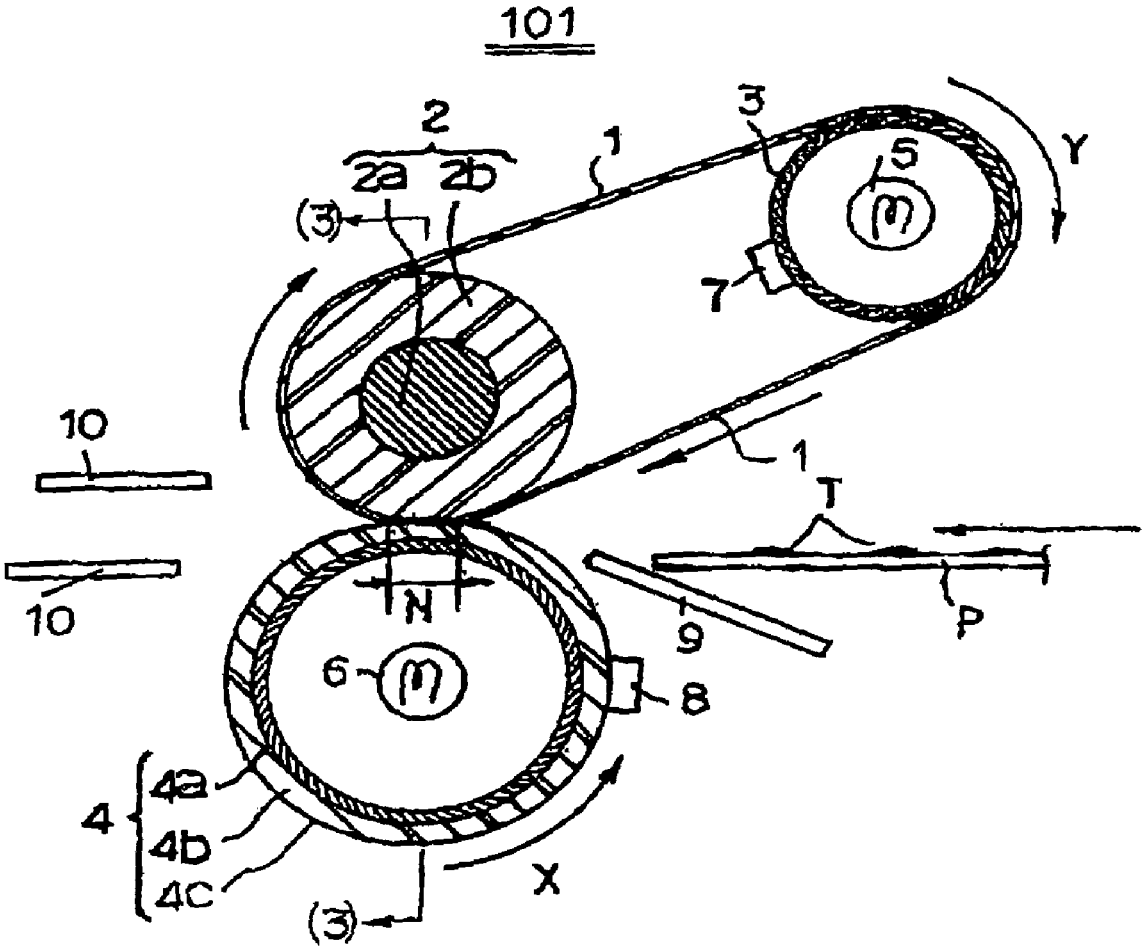
FIG. 2 is a schematic cross-sectional view of a fixing device according to an embodiment of the present invention.
Figure 3:
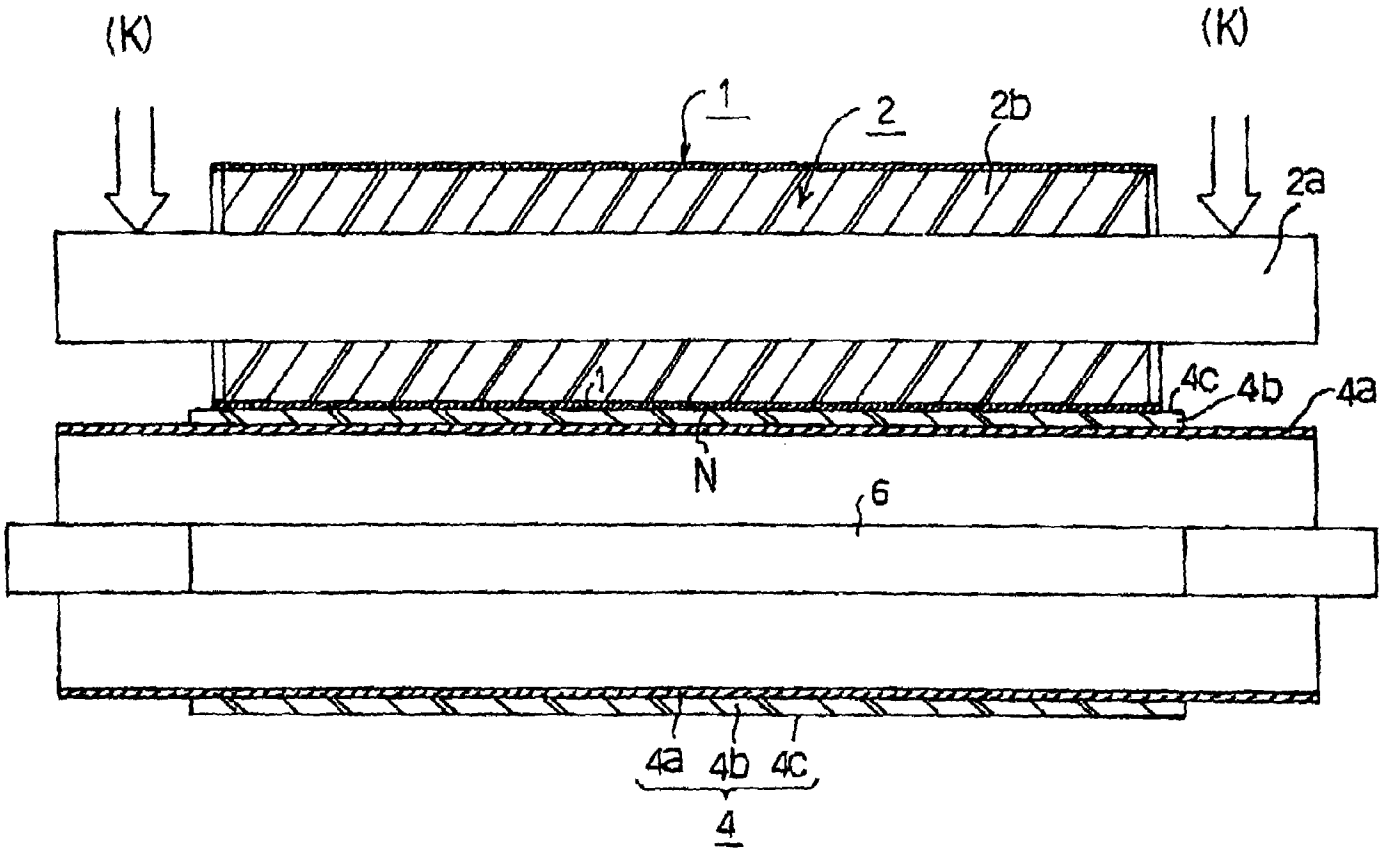
FIG. 3 is a schematic longitudinal sectional view taken along a line (3)—(3) in FIG. 2.

FIG. 2 is a schematic cross-sectional view illustrating a substantial structure of a fixing device 101 (image heating device) in this embodiment. FIG. 3 is a schematic longitudinal sectional view taken along a line (3)—(3) of FIG. 2.

The fixing device 101 comprises a fixing roller 2 (supporting member), a heating roller 3 (heating member), an endless fixing belt 1 (flexible belt) extended around the fixing roller 2 and the heating roller 3 with a predetermined tension, a pressing roller 4 (pressing rotatable member) pressed toward the fixing roller 2 with the fixing belt 1 therebetween, and heaters 5, 6, provided in the heating roller 3 and the pressing roller 4, respectively, for heating the fixing belt. A recording material P is introduced into the nip (fixing nip) formed between the pressing roller 4 and the fixing belt 1 and is fed by the nip. By this, the unfixed toner image T carried on the recording material P is heated and pressed by the heat or the fixing belt 1 which is heated by the heating roller 3 supplied with the heat from the heater 5, the heat of the pressing roller 4 which is heated by the heater 6 and the pressure of the fixing nip N, so that toner image is fixed on the recording material.

In this embodiment, the pressing roller 4 is rotatably supported by bearings at a fixed position in the fixing device at the opposite ends, and the fixing roller 2 is rotatably supported by bearings at the opposite ends so as to be pressed toward the pressing roller 4 with the fixing belt 1 therebetween by pressing mechanisms K including springs or the like at the opposite ends. Between the fixing belt 1 and the pressing roller 4 are press-contacted to each other to form a nip for receiving a recording material P carrying an unfixed toner image T to heat, fuse and press the toner image T to fix the toner image T on the recording material P. The heating roller 3 is rotatably supported by the bearings at the opposite ends and is pressed by a pressing mechanism so as to apply a predetermined tension to the fixing belt 1, thus functioning as a tension roller.

The fixing belt 1, the fixing roller 2, the heating roller 3 and the pressing roller 4 are rotated by a driving source.

In this embodiment, the pressing roller 4 is rotated in the direction of an arrow X by a driving source of a main assembly of the image forming apparatus. The fixing belt 1 is rotated in the direction of an arrow Y by t rotation of the pressing roller 4 through frictional force between the pressing roller 4 and the outer surface of the fixing belt 1. In addition, rotating forces are applied to the he fixing roller 2 and the heating roller 3 by the friction between the inner surface of the fixing belt 1 and the outer surfaces of the fixing roller 2 and the heating roller 3. Accordingly, by the rotation of the pressing roller 4, the fixing belt 1, the fixing roller 2 and the heating roller 3 are rotated substantially at the same peripheral speed or the pressing roller 4 (pressing roller driving type). When the recording material P is inserted into the fixing nip N, the rotations are caused by the frictional forces between the pressing roller 4 and the recording material P and between the recording material Page and the fixing belt 1.

The fixing roller 2 and the pressing roller 4 are operatively connected by an oneway gear provided at an end or the fixing roller 2 and a gear. When slip occurs between the pressing roller 4 and the fixing belt 1 or between the pressing roller 4 and the fixing belt 1 through the recording material P, the fixing roller 2 is driven by the one-way gear to keep the substantially the same peripheral speeds between the pressing roller 4 and the fixing belt 1.

Before and after the pressing roller 4, there are provided an entrance guide 9 and a sheet discharge guide 10 for constituting a feeding path for feeding the recording material P carrying the toner image T.

(1) Fixing Belt 1

In order to improve a quick start performance and to reduce the thermal capacity, the fixing belt 1 is preferably as follows. The film thickness is preferably not more than 150 μm and further preferably 30–80 μm. It is of a single layer structure of a material comprising fluorine resin material as a main component, such as PTFE, PFA or FEP (heat resistive material), or it is of a multi-layer structure comprising a base layer (endless belt) of a resin material such as, polyimide, polyamide-imide, polyetheretherketone (PEEK), polyethersulfone (PES), polyphenylenesulfide (PPS) or the like, or a material comprising as a main component metal material such as nickel (Ni), stainless steel (SUS) or the like, and a parting layer, provided on the outer surface thereof, of a material comprising as a main component fluorine resin material such as polytetrafluoroethylene (PTFE), perfluoroalkoxylalkane (PFA), tetrafluoroethylene (FEP).

In the case of a full-color image forming apparatus, the multi-layer may be such that base layer may be coated with a heat resistive elastic layer of silicone rubber, fluorine rubber or the like having a thickness of approx. 100 μm–800 μm to provide a high glossiness by uniformly fusing the toner image surface into a smooth surface. In this case, it is desirable to employ an oil applicator for applying the oil onto a fixing belt 1 in order to prevent toner offset by enhancing parting property between the fixing belt 1 and the toner image T on the recording material P (oil application type fixing device).

Or, another multi-layer structure wherein the outer surface of the heat resistive elastic layer of said silicone rubber or the like is coated with a parting layer of a material comprising as a main component fluorine resin material such as PTFE, PFA, FEP or the like. In this case, the oil applicator for applying the t oil onto the fixing belt 1 may be omitted, so that low cost oil-less type fixing device is accomplished.

In this embodiment, an oil-less fixing device is used, wherein the outer surface of polyimide resin material having a thickness of 50 μm (base layer) is coated with a heat resistive elastic layer of silicone rubber having a thickness of 300 μm, and the outer surface thereof is coated with a parting layer of PFA tube having a thickness of 30 μm. The flexible fixing belt 1 has the total thickness of 380 μm and the inner diameter of 60 mm. The surface hardness is 85° (Asker C hardness meter).

(2) Fixing Roller 2

The fixing roller 2 has a core metal 2*a* which is coated with a heat resistive elastic layer 2*b* of silicone rubber, fluorine rubber, a silicone sponge which is effective to provide a high heat insulation property to permit the quicker temperature rise of the fixing belt 1, or the like.

In this embodiment, the fixing roller 2 comprises a core metal 2*a* of steel having an outer diameter of ϕ14 mm, and the outer surface thereof is coated with a silicone sponge layer 2*b* having a thickness of 8 mm. The hardness is 40° (Asker C hardness meter), and the thermal conductivity of the silicone sponge is 0.08[W/(m·° C.)]. The outer diameter of the fixing roller 2 is approx. 30 mm.

(3) Heating Roller 3

The heating roller 3 containing the heater 5 therein is made of a metal pipe comprising as a main component a metal material such as aluminum, steel or the like having a high heat conductivity and having a small diameter and small thickness in order to improve the quick start property.

The fixing belt 1 is heated by the heater 5 through the heating roller 1, and the temperature of the heating roller 1 is detected by a temperature detecting element (thermister) 7. In response to the detection, the heater 5 is on-off-controlled to control the temperature of the heating roller 1 at a proper level so as to maintain the surface temperature of the fixing belt 1 at a predetermined level.

In this embodiment, the use is made with an aluminum heating roller 3 having a thickness of 1 mm and an outer diameter of 24 mm, and a halogen heater as the heater 5.

(4) Pressing Roller 4

In the case that pressing roller 4 comprises a core metal 4*a* coated with a heat resistive elastic layer 4*b* such as silicone rubber, fluorine rubber or the like, the heating apparatus is an oil application type fixing device, since oil application to the fixing belt 1 is desirable. The apparatus may be an oil-less fixing device when the outer surface of the heat resistive elastic layer 4*b* is coated with fluorine resin material layer of PTFE, PFA, FEP or the like to enhance a surface property of the pressing roller 4 and the parting property relative to the toner.

In this embodiment, the use is made with an oil-less fixing device having a pressing roller 4 in which an outer periphery surface of a core metal of steel 4*a* having a straight configuration and having a thickness of 1 mm is coated with a heat resistive elastic layer 4*b* of silicone rubber with a thickness of 2 mm which is uniform in the direction of a generating line of the pressing roller, and the outer surface thereof is further coated with a parting layer 4*c* of PFA tube having a thickness of 50 μm. The outer diameter of the pressing roller 4 is 40 mm, and the hardness is 70° (Asker C hardness meter).

The pressing roller has a straight configuration so that outer diameter is uniformly 40 mm at the longitudinal center portion and at the end portions.

In order to raise the temperature of the fixing belt 1 to the predetermined temperature quickly, this embodiment employs a halogen heater 6 in the pressing roller 4 and a temperature detecting element (thermister) 8 to detect the temperature of the pressing roller 4. The heater 6 is on-off-controlled in response to the detection to control the temperature of the pressing roller 4. However, the heater 6 may be omitted, only the heater 5 is used as the heating source, depending on the cases.

(5) Toner

The toner used in the oil-less fixing device is preferably toner internally containing oil or oil dispersed toner from the standpoint of prevention of cold offset and/or hot offset or improvement in the separation property from the fixing belt 1 and/or the pressing roller. In this embodiment, the oil-less fixing device is employed with the toner internally containing oil.

Figure 4:
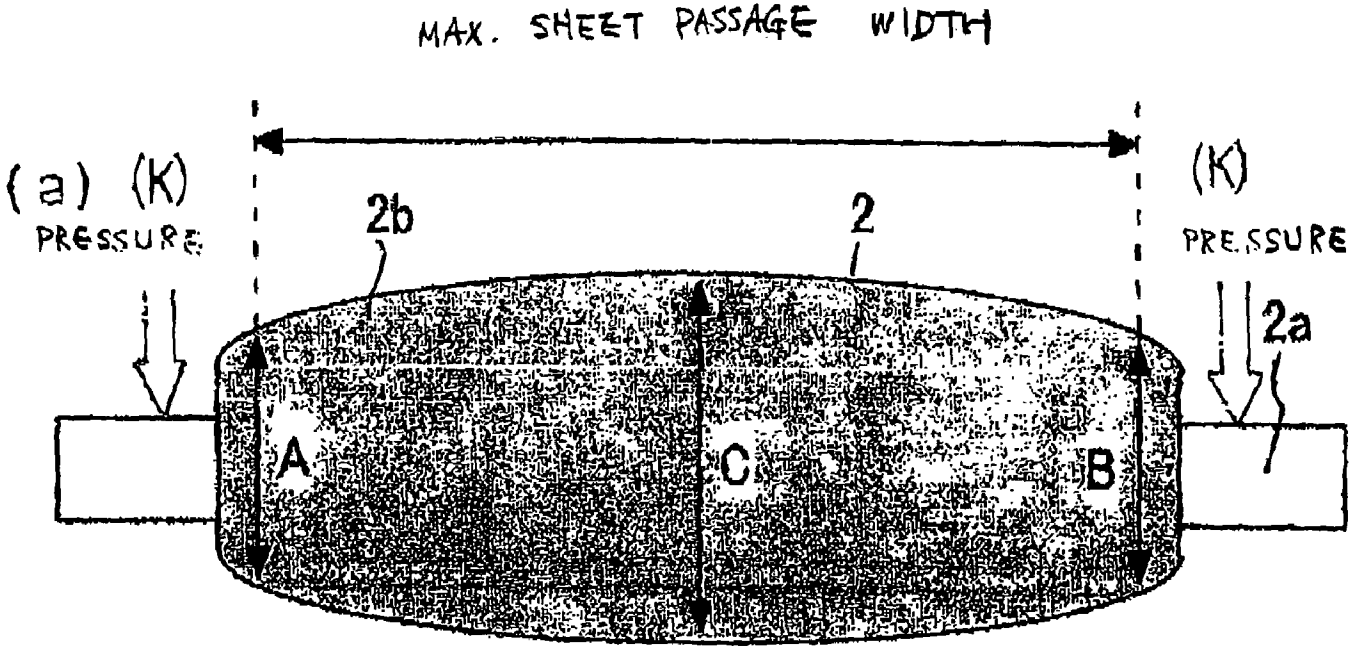
FIGS. 4(*a*) and 4(*b*) are schematic views of a flat surface configuration of the fixing roller and the fixing nip in Embodiment 1 of the present invention.
Figure 4:
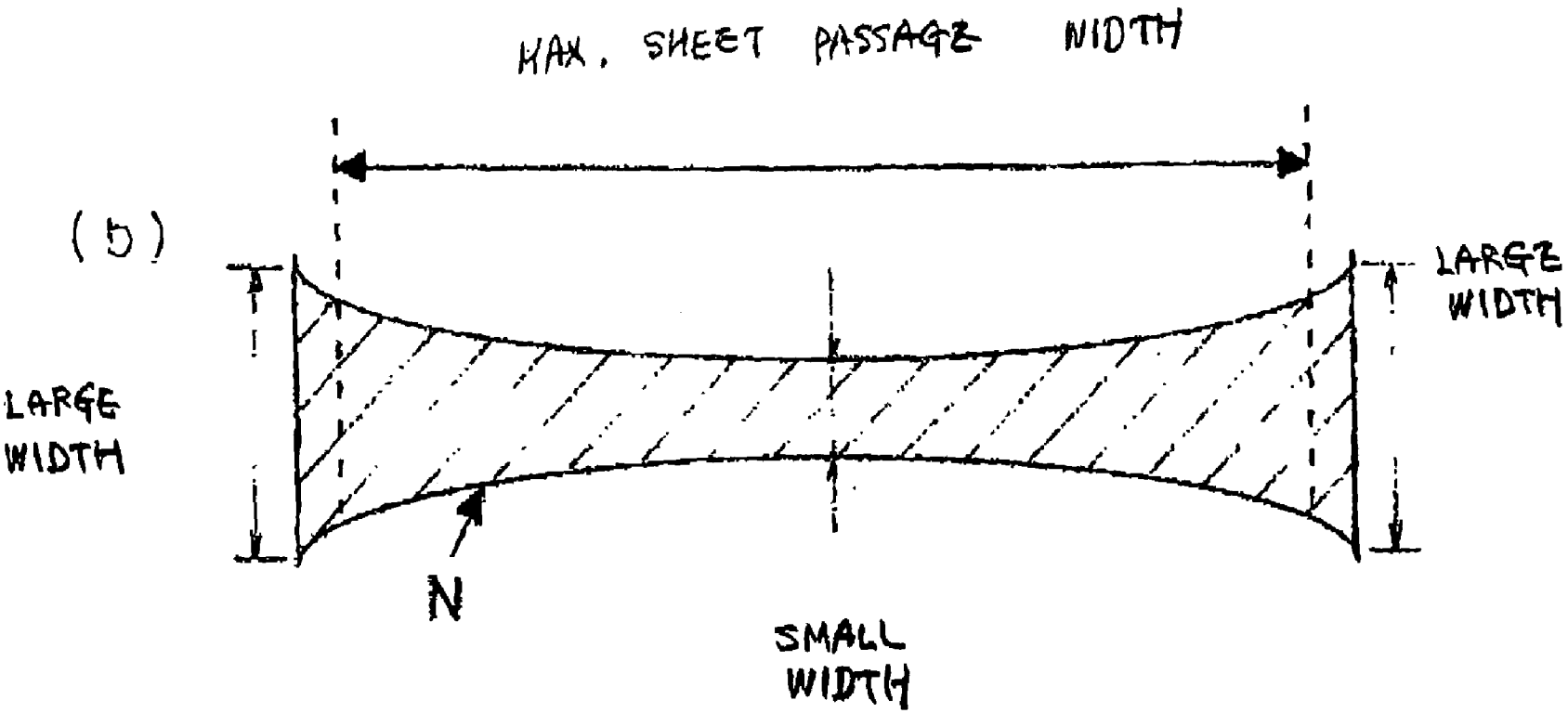
Figure 5:
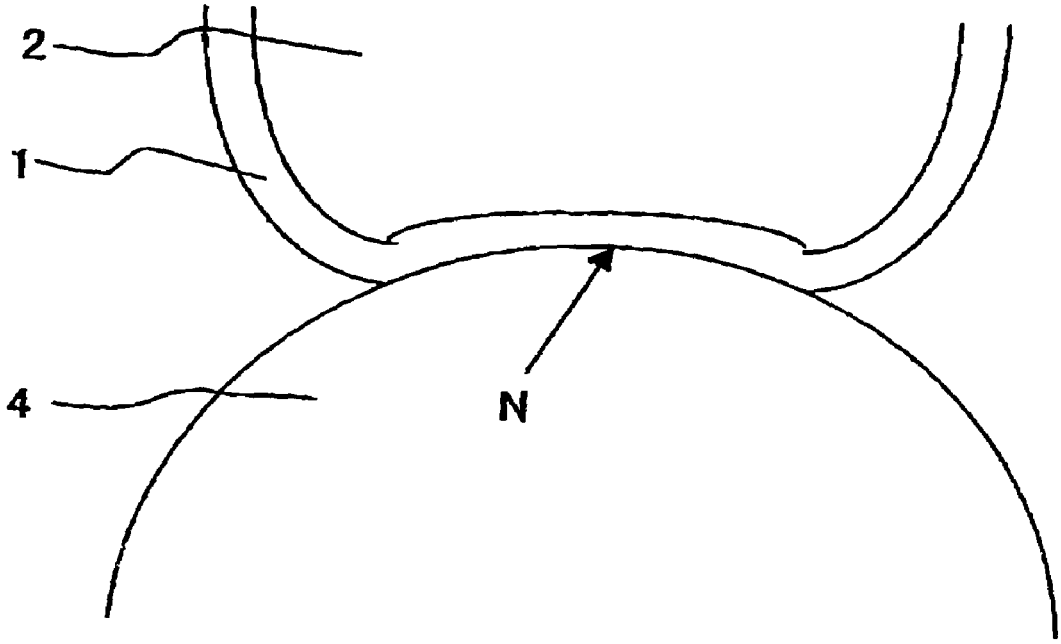
FIG. 5 is a schematic sectional view of the fixing nip in Embodiment 1 of the present invention.

(3) Fixing Nip Configuration 1) in the fixing device 101 of this embodiment, as shown in FIG. 4, (*a*), the fixing roller 2 has a positive crowning configuration an outer diameter C at the central portion in the maximum sheet passing width is larger than the outer diameters An and B at the end portions, and the pressing roller has a straight configuration, so that configuration of the fixing nip N formed between the fixing belt 1 and the pressing roller 4 is such that width of the fixing nip at the central portion with respect to the longitudinal direction of the fixing nip is slightly larger than those at the end portions, as shown in FIG. 4, (*b*) with exerggeration.

The description will be made as to the reason why this nip configuration is provided despite the fact that fixing roller 2 has a positive crowning configuration.

In this embodiment, the surface hardness of the fixing roller 2 measured through the belt is 65° (Asker C hardness meter), and the surface hardness or the pressing roller is 70° (Asker C hardness meter). When the pressing roller is press-contacted to the fixing roller through the belt, the positive crowning portion of the fixing roller is relatively easily deformed, since the fixing roller through the belt has a surface hardness lower than that of the pressing roller. As a result, the nip widths at the end portions are lightly larger than that as the central portion since the influence of the positive crowning configuration of the pressing roller is relatively smaller in the nip and since the pressure is relatively larger at the end portions because of the bending of the fixing roller. Therefore, the hardness of the fixing roller through the belt is preferably smaller than that of the pressing roller.

With such a surface hardness relation, the nip configuration in which the widths at the end portions are relatively larger can be provided despite the straight configuration of the pressing roller. As a result, the paper feeding with suppressed production of paper crease can be accomplished.

When the fixing operation is continuously carried out, the temperature of the pressing roller rises with the result of thermal expansion in the elastic layer of the pressing roller. However, since the pressing roller has the straight configuration, the thermal expansion difference in the longitudinal image forming range is small, so that difference in the nip width in the direction of the roller hardly changes as compared with the width before the start of the continuous fixing operation.

Therefore, even if the thermal expansion of the pressing roller occurs due to long time fixing operation, glossiness non-uniformity in the direction of the generating line of the roller can be prevented.

Using a fixing device 101 having a maximum sheet passage width is 297 mm ((A3 paper longitudinal sheet feed), recording materials P carrying unfixed toner images T were processed under the conditions of the recording material feeding speed of 104 mm/sec, the total pressure of the pressing mechanism K (total of the pressures at the opposite ends) of 300N (approx. 30 Kgf), the surface temperature of the fixing belt of 180° C.

The fixing roller 2 had a positive crowning configuration, as shown in FIG. 4. (*a*), with the central portion outer diameter C of 30 mm, the end portion outer diameter A=D of 29.7 mm, the positive crowning of 300 μm (crowning ratio of 0.3/29.7×100=1.01%), and the pressing roller had a straight configuration with the outer diameter of 40 mm at the central portion and the end portions. With this combination providing the nip configuration having a relatively larger diameters at the end portions as shown in FIG. 4, (*b*), continuous fixing operation for full-color image were carried out, and the glossiness difference between the central portion and the end portions did not increase, and the paper crease did not occur.

Here, the positive crowning degree of the fixing roller 2 is defined as follows with the outer diameters An and B at the opposite ends of the maximum sheet processing width of the fixing roller 2 and the outer diameter C 2 at the central portion of the maximum sheet processing width of the fixing roller 2:

$$\text{Positive crowning degree}=C-(A+B)/2$$

The positive crowning degree of the fixing roller 2 is not limited to these figures, and is properly determined by one skilled in the art in consideration of the thickness, the hardness of the heat resistive elastic layer 2*b* of the fixing roller 2, the rigidity of the core metal 2*a*, the thickness and the hardness of the heat resistive elastic layer 4*b* of the pressing roller 4, the rigidity of the core metal 4*a*, the pressure of the pressing mechanism K, the paper feeding speed and so on, in the structure of the fixing device and the structure of the image forming apparatus.

However, if the degree of the positive crowning is too large, the configuration of the fixing nip N becomes such that fixing nip width is small at the end portions, and large in the central portion, with the result of non-uniformity in the fixing property or non-uniformity in the color image particularly property such as chromaticity or the like or in the glossiness. Therefore, it is preferable that nip widths at the end portions are relatively larger with the smallest possible degree of the positive crowning.

2) The pressing roller 4 preferably has a small thermal capacity since then the pressing roller 4 takes less heat from t fixing belt 1, and therefore, the temperature of the pressing roller 4 quickly rises to permit quick start of the fixing belt 1. To accomplish this, the thickness of the core metal 4*a* of the pressing roller 4 is small, and the thickness of the heat resistive elastic layer 4*b* of the pressing roller 4 is small. However, if the heat resistive elastic layer 4*b* is thin, the width of the fixing nip N is small.

In order to provide a larger width of the fixing nip N, it is required that fixing roller hardness is small, and therefore, it is preferable that hardness of the fixing roller 2<the hardness or the pressing roller 4.

By the hardness of the fixing roller 2<the hardness of the pressing roller 4, the cross-sectional configuration of the fixing nip N, as shown in the schematic sectional view of the fixing nip N, is convex up, so that separation property between the fixing belt 1 and the toner is enhanced. By this, the separation defect of the recording material P sticking on the fixing belt 1 after passing through the fixing nip N and not separating from t fixing belt 1, can be prevented.

The hardness of the fixing roller 2 is preferably low from the standpoint of providing large fixing nip N width, more particularly, not more than 60° (Asker C hardness meter). However, since the fixing roller 2 is driven through the frictional force between the fixing roller 2 and the fixing belt 1, the fixing roller 2 is required to have a proper degree of strength. In view of this, the hardness of the fixing roller 2 is preferably not less than 10° (Asker C hardness meter).

3) in the case that heater is not contained in the fixing roller 2 as in the fixing device 101 of this embodiment, a heat insulation structure is preferable to prevent the fixing roller 2 taking heat from the fixing belt 1 since then the temperature rising speed of the fixing belt 1 is high. To accomplish this, the thermal conductivity of the heat resistive elastic layer 2*b* of the fixing roller 2 is preferably small, more particularly, the thermal conductivity of the heat resistive elastic layer 2*b* is not more than 0.16[W/(m·° C.)].

In order to enhance the heat insulation effect, the heat resistive elastic layer 2*b* is preferably not made of solid rubber, but is preferably sponge-like material (elastic layer) comprising air layer exhibiting a high heat insulation effect. Using the sponge-like elastic layer, the degree of the positive crowning can be made smaller then in the case of solid rubber elastic layer, since the bending of the fixing roller 2 and/or the pressing roller 4 is accommodated by the air layer. When the positive crowning configuration of the fixing roller 2 is given by abrasion, the abrading amount can be reduced, so that manufacturing time is saved, and therefore, the low cost and the reduction of waste generation is accomplished.

In this embodiment, the apparatus has been described as being an oil-less fixing device in which the surface layer of the fixing belt 1 and the surface layer of the pressing roller 4 are parting layers of fluorine resin material or the like, and the used toner internally contains oil. However, the present invention is applicable with the same advantageous effects to an oil application type fixing device wherein the surface layer of the fixing belt 1 and the surface layer of the pressing roller 4 are heat resistive elastic layers of silicone rubber or the like, and an oil applicator is used to apply oil to the fixing belt 1 and/or the pressing roller 4. The oil-less fixing device, as compared with an oil application fixing device, cold offset and hot offset tend to occur, and the separation performance of the toner relative to the fixing belt 1 and/or the pressing roller 4 is low.

When this embodiment is used with an oil-less fixing type device, the advantages in the uniform fixing property, the color image particularly property such as the chromaticity, the lightness, the chromaticity and so on, uniform glossiness, and the like, are more remarkable than when it is used with the oil application type fixing device.

As described in the foregoing, despite the straight configuration of the pressing roller, the change in the nip width with respect to the longitudinal direction can be reduced, and therefore, the feeding performance of the belt is stabilized, even if thermal expansion of the elastic layer of the pressing roller is produced.

Embodiment 2

The description will be made as to Embodiment 2.

Figure 6:
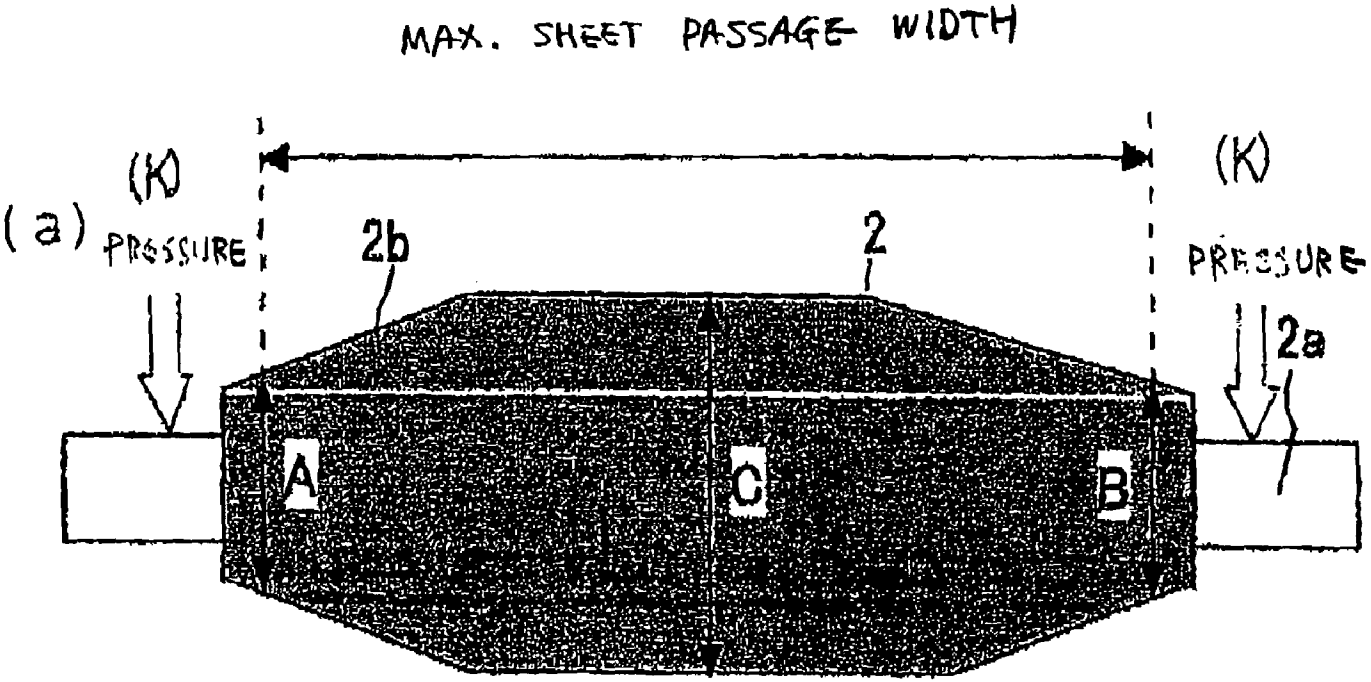
FIGS. 6(*a*) and 6(*b*) are schematic views of a configuration of the fixing roller a flat surface configuration of the fixing nip according to Embodiment 2 of the present inventon.
Figure 6:
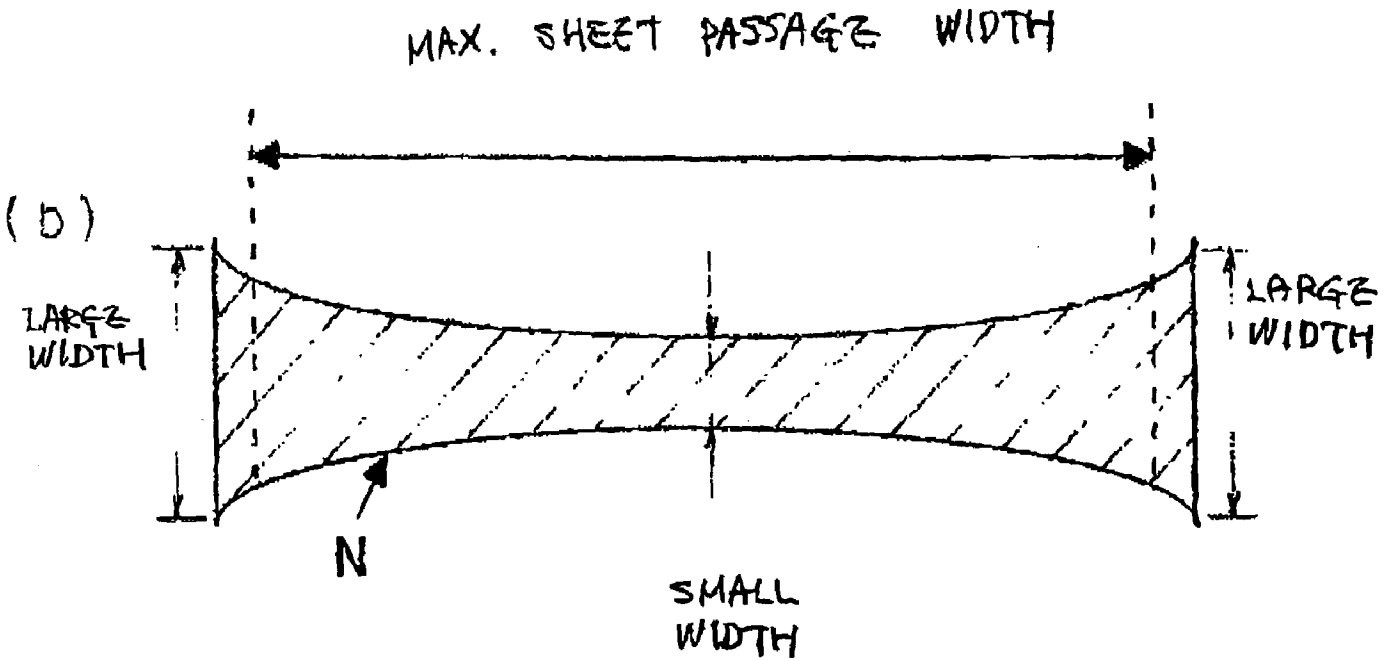
Figure 7:
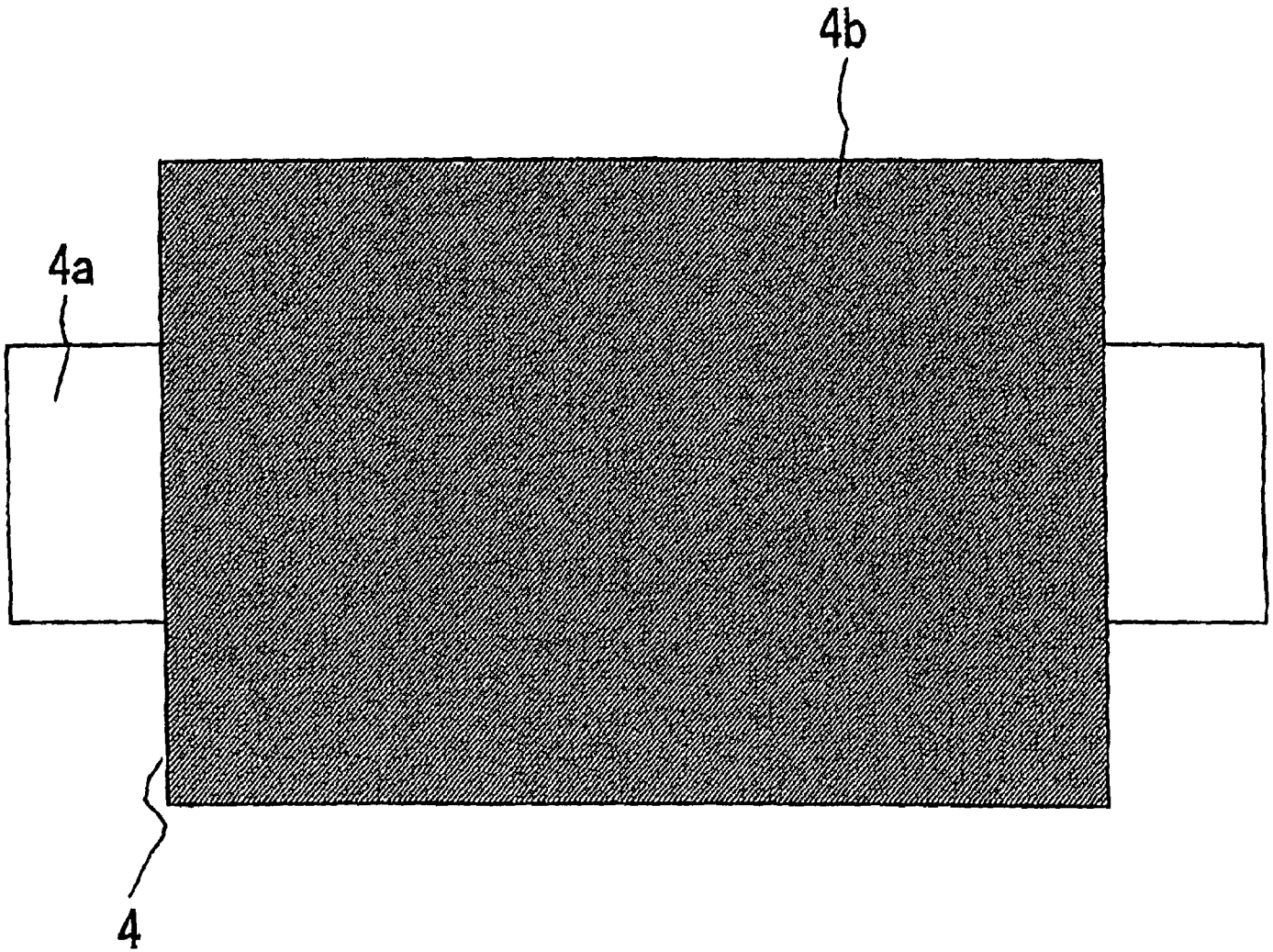
FIG. 7 is a schematic view of a configuration of a pressing roller.

In Embodiment 1, the configuration of the fixing roller 2 is such that outer diameter of the fixing roller 2 is non-linearly decreased from the central portion to the end portions. In the second embodiment, as shown in FIG. 6, (*a*) with exaggeration, the outer diameters of the opposite end portions are linearly decreased (positive taper configuration) so that fixing nip N has a flat surface configuration in which the widths at the end portions are large as shown in FIG. 6, (*b*). With this structure, too, the rotation diameter or the belt is larger in the central portion than at the end portions, the problem of shift of the belt toward the center can be avoided. The surface hardness of the fixing roller, the surface hardness of the pressing roller and the surface hardness of the fixing roller are the same as with Embodiment 1.

The combination of the fixing roller 2 having the positive taper configuration and the pressing roller having the straight configuration is also effective to provide the nip N configuration having the larger width at the end portions, and therefore, the same advantageous effects as the Embodiment 1 can be provided.

Here, the degree of the positive taper of the fixing roller 2 is defined as follows with the outer diameters An and B at the opposite ends of the maximum sheet processing width of the fixing roller 2 and the outer diameter C at the central portion of the maximum sheet processing width of the fixing roller 2:

$$\text{Positive taper degree}=C-(A+B)/2.$$

That is, the degree of the positive taper is calculated in the same manner as n Embodiment 1.

The taper may start from the longitudinal center of the fixing roller 2, or the central portion of the fixing roller 2 may be made substantially straight, and the taper may start from points slightly away from the center, depending on the nature of the fixing device.

In the embodiment, when the degree of the positive crowning is the same as the degree of the positive taper, the width of the flat surface configuration of the fixing nip N is larger at the end portions than in the central portion. This is accomplished by the substantially straight is configuration in the central portion (⅓ of the maximum sheet processing width) of the fixing roller 2 and by the taper configuration at the opposite end portions (approx. ⅓ at each of the end portions) of the fixing roller 2.

Using a fixing device 101 having a maximum sheet passage width is 297 mm ((A3 paper longitudinal sheet feed), recording materials P carrying unfixed toner images T were processed under the conditions of the recording material feeding speed of 104 mm/sec, the total pressure of the pressing mechanism K (total of the pressures at the opposite ends) of 300N (approx. 30 Kgf), the surface temperature of the fixing belt of 180° C. c The fixing roller 2 had a positive tapered configuration, as shown in FIG. 6, (*a*), with the central portion outer diameter C of 30 mm, the end portion outer diameter A=B of 29.7 mm, the positive taper of 300 μm, and the pressing roller had a straight configuration with the outer diameter of 40 mm at the central portion and the end portions. With this combination providing the nip configuration having a relatively larger diameters at the end portions as shown in FIG. 6, (*b*), continuous fixing operation for full-color image were carried out, and the glossiness difference between the central portion and the end portions did not increase, and the paper crease did not occur.

When the positive taper is formed in the fixing roller 2 by abrasion, the abrasion operation is easier because it is straight as contrasted to the case of the positive crowning configurations and therefore, the manufacturing time and the cost can be reduced.

Embodiment 3

Figure 8:
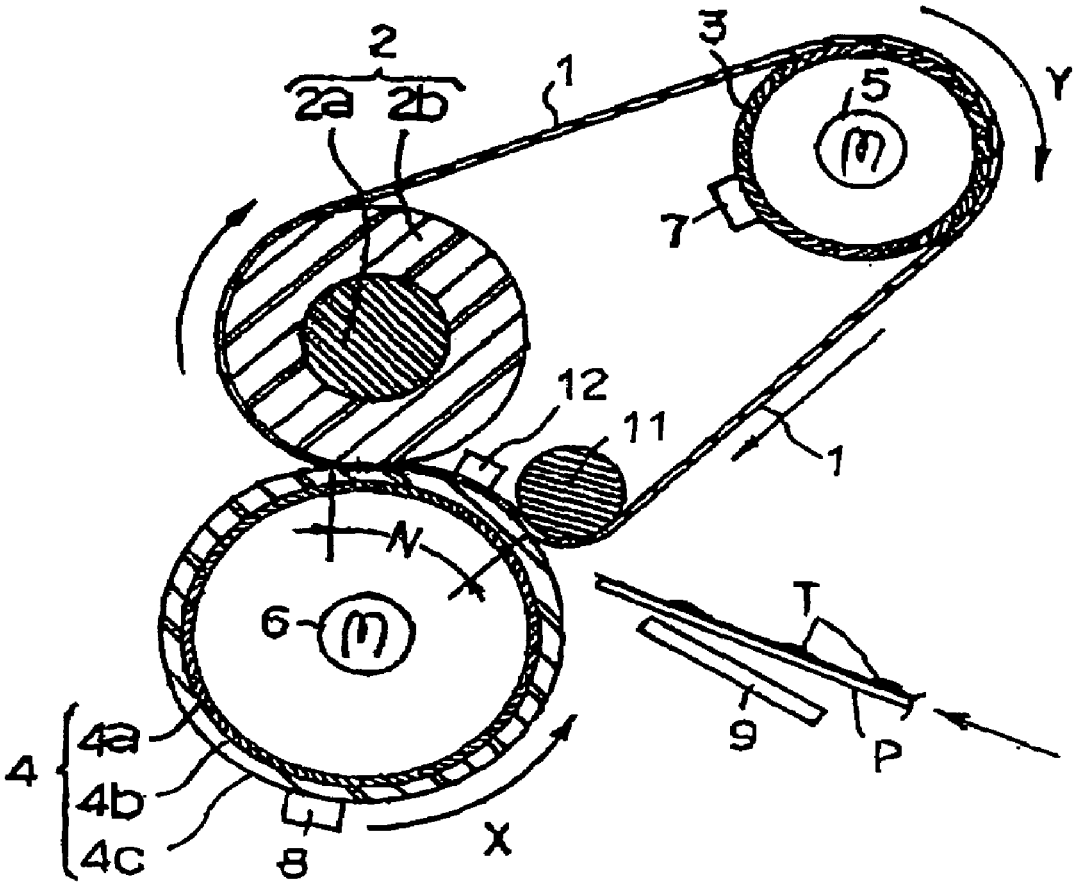
FIG. 8 is a schematic sectional view or a fixing device according to Embodiment 4 of the present invention.

Referring to FIG. 8, the description will be made as to Embodiment 3.

In Embodiments 2 and 3, the fixing belt 1 is extended around the fixing roller 2 and the heating roller 3 (two-shaft type). The present invention is applicable to a three-shaft structure using an auxiliary fixing roller 11, as shown in FIG. 8, with which the width of fixing the nip N is relatively larger, and the amount of heat applied to the recording material P and the toner image T is larger.

The description will be made as to.

As shown in FIG. 8, the auxiliary fixing roller 11 (second supporting member) is pressed against the pressing roller 4 with a predetermined pressure such that pressing roller 4 is wrapped by the fixing belt 1, by which the width of the fixing nip N is increased to increase the heating time for the recording material P and the toner image T, thus enhancing the fixing property.

The auxiliary fixing roller 11 may have a multi-layer structure comprising a metal roller such as aluminum, steel or the like roller, coated with a heat resistive elastic layer, similarly to the fixing roller 2. In this embodiment, the use is made with a steel roller having an outer diameter of 10 mm, which is coated with a silicone sponge having a thickness of 2 mm to provide an auxiliary fixing roller 11 having a hardness of 45° (Asker-C) and an outer diameter of 14 mm, the thermal conductivity of the silicone sponge being 0.08[W/(m·° C.)].

In this embodiment, the outer diameter in the central portion is 14 mm, and the outer diameters at the opposite end portions are 13.7 mm. Therefore, the positive crowning degree is 300 μm. The positive crowning ratio is 0.3/13.7×100=2.19%. The shaft portion which is influential to the bending due to the pressure is made of metal as with the fixing roller. Since the outer diameter thereof. Is smaller than that of the fixing roller, the bending by the same pressure is larger. In view of this, in order to provide the ratio of the nip widths at the central portion and the end portion being substantially the same as the nip width by the fixing roller 2, the degree of the crowning is preferably larger than the fixing roller.

In order to provide an equivalent pressure in the rotational direction in the fixing nip N in FIG. 8, an urging member 12 may be provided between t fixing roller 2 and the auxiliary fixing roller 11.

The auxiliary fixing roller 11 may be disposed upstream or downstream of the fixing roller 2 with respect to the feeding direction of the recording material. In this embodiment, it is disposed in the upstream side.

Similarly to Embodiments 1 and 2, the pressing roller has a straight configuration, and the fixing roller 2 and the auxiliary fixing roller have the positive crowning configuration or positive taper configuration, by which the nip configurations have larger widths in the end portions than in the central portions, respectively. By this, the glossiness non-uniformity in the longitudinal direction can be prevented even in the continuous fixing operation while preventing production or paper crease.

The degree of positive crowning and the degree of the positive taper of the auxiliary fixing roller 11, similarly to the fixing roller 2, are calculated as follows with the outer diameters G and H at the opposite ends of the maximum sheet processing width of the fixing roller 2 and the outer diameter I at the central portion of the maximum sheet processing width of the fixing roller 2.

The degree of positive crowning or positive taper=I−(G+H)/2.

(Others)

1) in the foregoing, the description has been made with respect to the embodiments of the present invention. Various values in Embodiment 1–3 are only examples, and may be determined by one skilled in the art in consideration of natures of the image heating device and the image forming apparatus.

2) the present invention is not limited to the application to a fixing device, but is applicable to another belt heating apparatus.

3) the fixing belt 1 in the form of a flexible movable member is not limited to the endless type as in the embodiments, but may be a rolled non-endless member which is taken out and used and rewound.

4) the heating structure of the fixing belt 1 which is a flexible movable member may be different from the heating roller 3 in the above-described embodiments, more particularly, other inside heating means or outside heating means are usable. In addition, the fixing belt 1 may be provided with an electromagnetic induction heat generation property layer, wherein an alternating magnetic field is applied to the fixing belt 1 so that belt per se generates heat by induction heat generation.

5) usage of the image heating device of this invention is not limited to the image fixing device, but is applicable to a temporary fixing device for temporarily fixing an unfixed image on the recording material. A surface property improving device for improving the surface property of the recording material having the fixed image, and the like.

6) in the foregoing embodiments, the belt is contacted to the unfixed image, but the belt may be contactable to the side of the recording material opposite the side carrying the unfixed image.

Even if the thermal expansion occurs in the elastic layer of the pressing roller, the change in the nip width in the longitudinal direction can be minimized.

While the invention has been described with reference to the structures disclosed herein, it is not confined to the details set forth and this application is intended to cover such modifications or changes as may come within the purpose of the improvements or the scope of the following claims.

What is claimed is:

1. An image heating apparatus comprising:

an endless belt;

heating means for heating said belt;

a first rotatable member for rotatably supporting said belt, said first rotatable member having an elastic layer with an outer diameter which is larger in a longitudinal central portion than in opposite longitudinal end portions;

a second rotatable member disposed opposed to said first rotatable member with said belt therebetween, wherein said second rotatable member cooperates with said first rotatable member to form a nip in which an image on a recording material is heated;

urging means for urging, toward said second rotatable member, opposite ends of a rotation shaft of said first rotatable member, wherein said nip has a width which is larger in the opposite longitudinal end portions than in the longitudinal central portion in a state before said elastic layer thermally expands by a heating operation of said apparatus.

2. An apparatus according to claim 1, wherein said first rotatable member has a hardness which is lower than that of said second rotatable member.

3. An apparatus according to claim 1, wherein an outer diameter of said second rotatable member in the opposite longitudinal end portions is substantially equal to that in the longitudinal central portion.

4. An apparatus according to claim 2, wherein an outer diameter of said second rotatable member in the opposite longitudinal end portions is substantially equal to that in the longitudinal central portion.

5. An apparatus according to claim 3, wherein said second rotatable member has a core metal and an elastic layer thereon, and wherein an outer diameter of said core metal in the opposite longitudinal end portions is substantially equal to that in the longitudinal central portion.

6. An apparatus according to claim 1, wherein said second rotatable member has a core metal and an elastic layer thereon, and wherein an outer diameter of said core metal in the opposite longitudinal end portions is substantially equal to that in the longitudinal central portion.

7. An apparatus according to claim 1, wherein said elastic layer comprises rubber.

8. An apparatus according to claim 2, wherein said elastic layer comprises rubber.

* * * * *

UNITED STATES PATENT AND TRADEMARK OFFICE

CERTIFICATE OF CORRECTION

PATENT NO. : 7,020,423 B2
APPLICATION NO. : 10/763166
DATED : March 28, 2006
INVENTOR(S) : Kazuaki Ono et al.

It is certified that error appears in the above-identified patent and that said Letters Patent is hereby corrected as shown below:

COLUMN 2:
Line 12, “an” should read --on--.

COLUMN 5:
Line 1, “is” (2nd occurrence) should be deleted.
Line 51, “discharged” should read --is discharged--.

COLUMN 6:
Line 31, “he” should be deleted.

COLUMN 8:
Line 41, “in” should read --In--.
Line 51, “exerggeration.” should read --exaggeration.--.
Line 63, “lightly” should read --slightly--.

COLUMN 9:
Line 23, “((A3” should read --(A3--.

COLUMN 10:
Line 33, “in” should read --In--.
Line 48, “then” should read --than--.

COLUMN 11:
Line 58, “is” should be deleted.
Line 64, “((A3” should read --(A3--.

UNITED STATES PATENT AND TRADEMARK OFFICE

CERTIFICATE OF CORRECTION

PATENT NO. : 7,020,423 B2
APPLICATION NO. : 10/763166
DATED : March 28, 2006
INVENTOR(S) : Kazuaki Ono et al.

It is certified that error appears in the above-identified patent and that said Letters Patent is hereby corrected as shown below:

COLUMN 12:
Line 3, "180°C. c" should read --180°C.--.
Line 56, "thereof. Is" should read --thereof is--.

Signed and Sealed this

Seventh Day of November, 2006

JON W. DUDAS
*Director of the United States Patent and Trademark Office*